US008096077B1

(12) United States Patent
Caywood

(10) Patent No.: US 8,096,077 B1
(45) Date of Patent: Jan. 17, 2012

(54) RIFLE RECOIL ABSORBING STRAP ASSEMBLY

(76) Inventor: Clayton R. Caywood, Cedaredge, CO (US)

( * ) Notice: Subject to any disclaimer, the term of this patent is extended or adjusted under 35 U.S.C. 154(b) by 311 days.

(21) Appl. No.: 12/386,069

(22) Filed: Apr. 13, 2009

(51) Int. Cl.
*F41C 27/00* (2006.01)

(52) U.S. Cl. ..... 42/94; 73/167; 224/150

(58) Field of Classification Search ..... 42/94; 73/167; 224/150
See application file for complete search history.

(56) References Cited

U.S. PATENT DOCUMENTS

| | | | | | |
|---|---|---|---|---|---|
| 3,501,074 | A * | 3/1970 | Emerick | 224/606 |
| 4,012,860 | A * | 3/1977 | Auger | 42/94 |
| 5,070,636 | A * | 12/1991 | Mueller | 42/94 |
| 5,669,170 | A * | 9/1997 | Norris | 42/85 |
| 5,682,700 | A * | 11/1997 | Sandberg | 42/94 |
| 5,685,103 | A * | 11/1997 | Wiggins | 42/94 |
| 5,758,447 | A * | 6/1998 | Venetz | 42/94 |
| 5,811,720 | A * | 9/1998 | Quinnell et al. | 89/37.04 |
| 5,881,487 | A * | 3/1999 | Chalker | 42/85 |
| 5,913,668 | A * | 6/1999 | Messer | 42/94 |
| 6,266,910 | B1 * | 7/2001 | Horine | 42/94 |
| 7,823,318 | B2 * | 11/2010 | Hall | 42/94 |
| 2006/0137233 | A1 * | 6/2006 | Meeks | 42/94 |
| 2006/0230664 | A1 * | 10/2006 | Eddins | 42/94 |
| 2007/0278261 | A1 * | 12/2007 | Gallagher | 224/150 |
| 2007/0278262 | A1 * | 12/2007 | Gallagher | 224/150 |
| 2008/0086928 | A1 * | 4/2008 | Pereksta | 42/94 |
| 2009/0025267 | A1 * | 1/2009 | Reinert et al. | 42/94 |
| 2009/0049731 | A1 * | 2/2009 | Seuk | 42/94 |
| 2010/0018102 | A1 * | 1/2010 | Minges | 42/94 |

* cited by examiner

*Primary Examiner* — Michael Carone
*Assistant Examiner* — Samir Abdosh
(74) *Attorney, Agent, or Firm* — Edwin H. Crabtree; Ramon L. Pizarro

(57) ABSTRACT

A rifle recoil absorbing strap assembly for absorbing rifle recoil from a rifle, the strap assembly preventing the bruising of a shoulder when firing the rifle and without having to permanently mount the strap assembly on a target shooting bench, a table or a horizontal support member. The strap assembly includes an elongated, flexible, horizontal first strap member with adjustable and releasable fastener. The adjustable and releasable fastener is used for securing together a first end and a second end of the first strap member. Also, the strap assembly includes a flexible, vertical second strap member with a first end and an opposite second end. The first and second end of the second strap member are adapted for receipt around a front portion of the rifle and secured thereto for preventing upward movement of the rifle when firing. Further, the strap assembly includes a rifle butt cradle adapted for receiving and securing a rifle butt of the rifle therein. Whereby, when the strap assembly is secured to a rifle securing object and the rifle is held thereon, the strap assembly greatly reduces rifle recoil during the firing of the rifle.

17 Claims, 3 Drawing Sheets

RIFLE RECOIL ABSORBING STRAP ASSEMBLY

BACKGROUND OF THE INVENTION (a) Field of the Invention

This invention relates to a rifle recoil absorbing strap assembly for holding a rifle, a pistol and other types of firearms thereon during long range, target shooting, distance sighting, hunting and other firing activities and more particularly, but not by way of limitation, to a rifle recoil absorbing strap assembly that is lightweight, portable and versatile. The strap assembly is adapted to be quickly attached to a target shooting bench, a tree trunk and branch, a hunting blind, a vehicle tailgate, a off-highway vehicle cargo rack, a fence post, on top of a ground surface, a monopod, a bipod, a tripod and other similar permanent and non-permanent rifle support objects when firing a high powered rifle, pistol or any firing mechanism.

(b) Discussion of Prior Art

Heretofore, there have been a variety of rifle recoil absorbing devices, recoil suppressing supports, and methods of attenuating firearm recoil. In U.S. Pat. Nos. 2,729,975 to Hawthorne et al. and 7,313,884 to Eddins, two different types of recoil suppressing rifle supports are disclosed and shown permanently mounted on support frames. Also, U.S. Pat. Nos. 4,799,329 to Nodo and 5,811,720 to Quinnell et al. illustrate a firearm recoil attenuator and a shooting rest with recoil reduction system mounted permanently on a support member. In U.S. Pat. No. 5,758,447 to Venetz, a recoil absorbing device is described having a rifle rest member permanently attached to a horizontal surface and a first strap member with weighted bag and a second strap member used to hold a rifle butt in place during the firing of the rifle.

None of the above mentioned patented recoil absorbing devices and systems disclose the unique features and structure of the subject flexible strap assembly that can be quickly attached to various objects for absorbing rifle recoil when firing a high powered rifle.

SUMMARY OF THE INVENTION

In view of the foregoing, it is a primary objective of the subject invention to provide a rifle recoil absorbing strap assembly for absorbing rifle recoil, preventing bruising of the shoulder and without having to permanently mount the strap assembly on a target shooting bench, a table or a horizontal support member.

Another object of the strap assembly is the invention is rugged in construction, simplistic in design, adapted for different sizes and shapes of rifles, pistols, and other firearms, and can be easily and quickly mounted on different types of horizontal and vertical support objects such as a target shooting bench, a hunting blind, a tree trunk and branch, a vehicle tailgate, an off-highway vehicle cargo rack, a fence post, on a ground surface, a monopod, bipod, tripod and other support objects.

Yet another object of the invention is the strap assembly includes a rifle butt cradle, made of strap material, for holding a rifle butt securely therein. The rifle butt cradle includes a horizontal, reinforcing member in the bottom of the butt cradle to prevent the strap assembly from slipping and folding over an edge of a target shooting bench and other horizontal surfaces when attached thereto.

The subject strap assembly is adapted for engaging and holding a rifle in place during target shooting and hunting. The strap assembly includes an elongated, flexible, horizontal first strap member with adjustable and releasable fastener. The adjustable and releasable fastener is used for securing together a first end and a second end of the first strap member. Also, the strap assembly includes a flexible, vertical second strap member with a first end and an opposite second end. The first and second end of the second strap member are adapted for receipt around a front portion of the rifle and secured thereto for preventing upward movement of the rifle when firing. Further, the strap assembly includes a rifle butt cradle adapted for receiving and securing a rifle butt of the rifle therein. Whereby, when the strap assembly is secured to a rifle securing object and the rifle is held thereon, the strap assembly greatly reduces rifle recoil during the firing of the rifle.

These and other objects of the present invention will become apparent to those familiar with rifle recoil absorbing devices and methods when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised and in which.

DETAILED DESCRIPTION OF THE PREFERRED EMBODIMENTS

Figure 1:
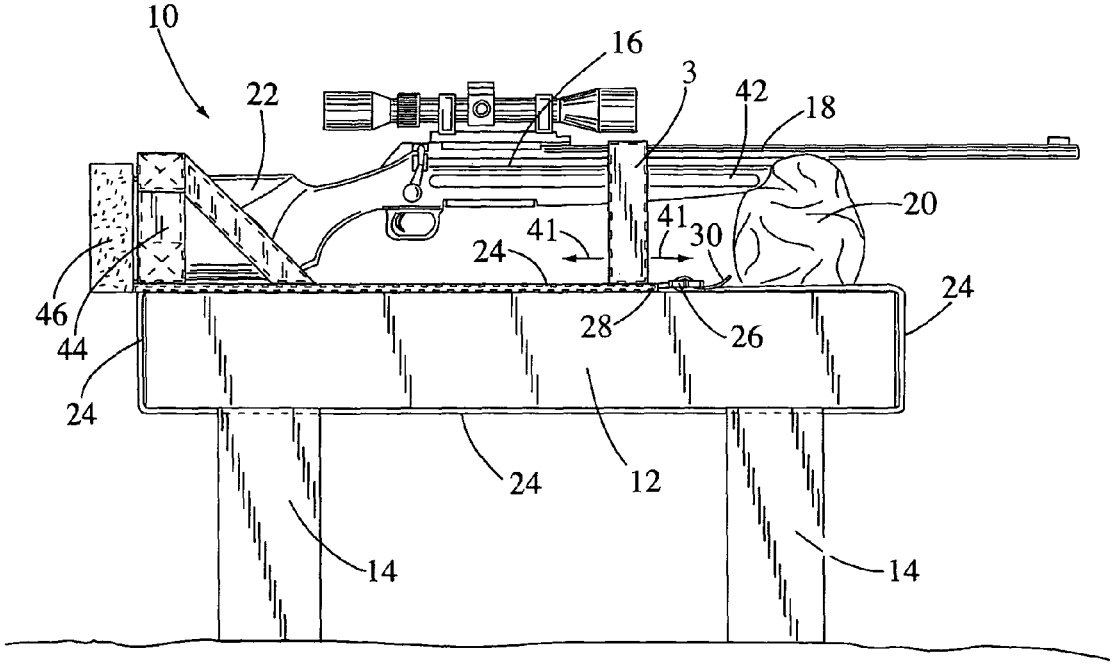
FIG. 1 is a side view of the subject rifle recoil absorbing strap assembly attached to a top of a target shooting bench with the strap assembly holding a high powered rifle in place on the bench.

In FIG. 1, a side view of the subject rifle recoil absorbing strap assembly is shown having general reference numeral 10. The strap assembly 10 is made of heavy flexible material made of nylon, polyester and the like. The strap assembly 10 is illustrated mounted on top of a target shooting bench 12 with bench legs 14 and holding a high powered rifle 16 in place on the bench 12 for target shooting. A barrel 18 of the rifle 16 is shown resting on top of a small portable sandbag 20 in the front of the bench. The barrel 18 can also be supported using various types of support objects other than the sandbag 20. A rifle butt 22 is shown resting on top of the rear of the bench. While the rifle 16 is shown in the drawings, it should be kept in mind that the strap assembly 10 can secure various sizes and shapes of handheld firearms equally well without departing from the spirit and scope of the invention. Also by design, the strap assembly 10 is portable and can be mounted on both fixed or mobile objects for versatility in use.

The strap assembly 10 includes an elongated, flexible, horizontal first strap member 24 with adjustable and releasable fastener 26. The adjustable and releasable fastener 26 is used for securing together a first end 28 and a second end 30 of the first strap member 24. In this drawing, the first strap member 24 is shown looped around the top and bottom of the bench 12 and tightened thereon using the adjustable and releasable fastener 26. The fastener 26 can also be used as a grommet for securing the strap assembly 10 to a support object.

Also, the strap assembly 10 includes a flexible, vertical second strap member 32 with a first end 34 having loop fasteners 36 and a second end 38 having hook fasteners 40. The first end 34 with loop fasteners 36 and the second end 38 with hook fasteners 40 are shown clearly in FIG. 2. The second strap member 32 is slidably mounted, as indicated by arrows 41, along a length of the first strap member 24 for adjustment prior to receipt around a front portion 42 of the rifle 16. The second strap member 32 is used to prevent upward movement of the rifle when firing.

Further, the strap assembly 10 includes a rifle butt cradle 44, make of strap material, adapted for receiving and securing the rifle butt 22 of the rifle 16 therein. As mentioned above, the strap assembly 10 can be secured to various types of permanent or moveable rifle securing objects with the rifle 16 held thereon. The rifle butt cradle 44 can include a foam shoulder pad 46 to further reduce any chance of shoulder bruising, when using the strap assembly 10.

Figure 2:
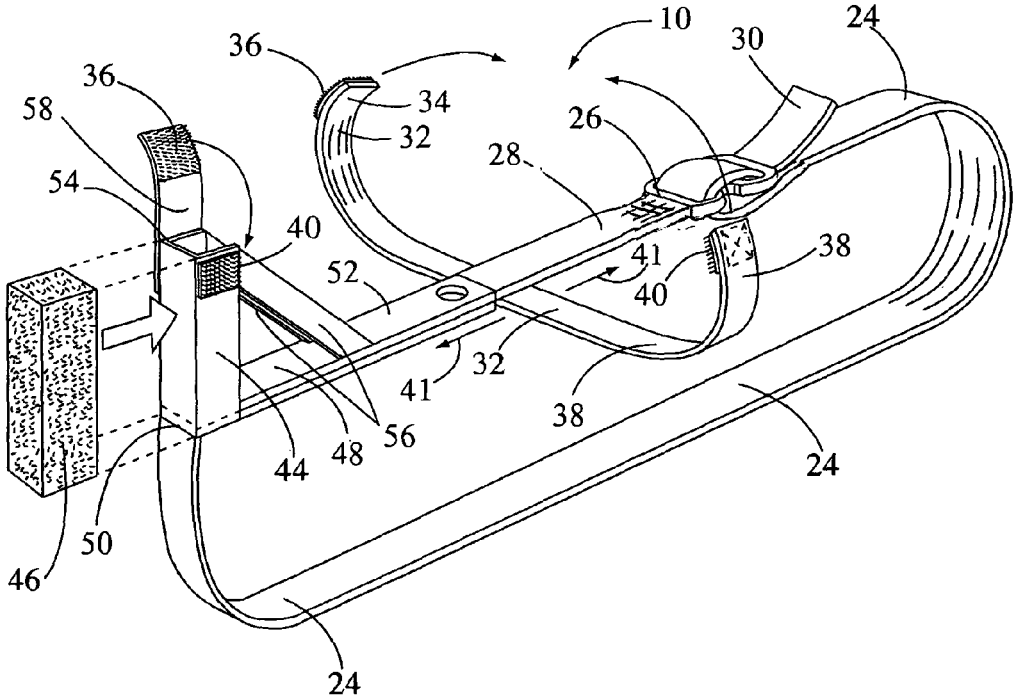
FIG. 2 is a perspective view of the strap assembly with an elongated, horizontal first strap member, a vertical second strap member and a rifle butt cradle with horizontal reinforcing member.

In FIG. 2, a perspective view of the strap assembly 10 is illustrated without the rifle 16 secured thereon. In this drawing, the adjustable and releasable fastener 26 is shown with the second end 30 of the elongated first strap member 24 looped therethrough for tightening the strap assembly 10 on various objects. Also, the vertical second strap member 32 is shown with the loop fasteners 36 on the first end 34 and released from the hook fasteners 40 on the second end 38. Obviously, other types of releasable fasteners can be used equally well for securing the first end 34 to the second end 38 and without hook and loop fasteners.

Also in this drawing, the rifle butt cradle 44 is shown in greater detail and including a horizontal reinforcing member 48, shown in dashed lines, received in a horizontal sleeve 50 in a horizontal bottom portion 52 of the cradle 44. The cradle 44 also includes a "U" shaped vertical portion 54 and angled support straps 56. The "U" shaped vertical portion 54 of the cradle 44 is sized to receive different sizes of rifle butts. Further, a top of the vertical portion 54 includes a flap 58 with loop fasteners 36 for securing the flap to hook fasteners 40 on one side of the vertical portion 54 and holding the rifle butt 22 securely when firing the rifle 16. The cradle 44 along with the flap 58 can encompass the rifle butt 22 when using the strap assembly 10 with or without using the bench 12, as shown in FIG. 3.

Figure 3:
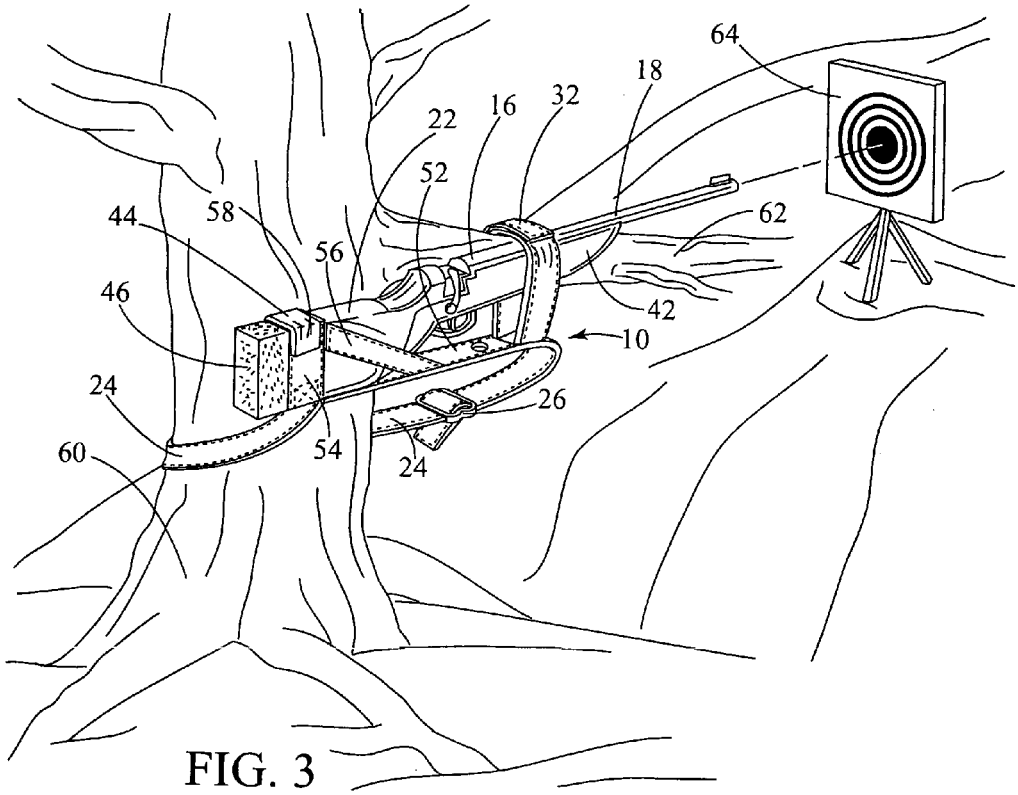
FIG. 3 is a perspective view of the strap member with the rifle attached thereto. In this drawing, the first strap member is shown wrapped around a tree trunk with the second strap member received around a tree branch. The strap assembly, in this example, is used to hold the rifle in place for distance sighting using a target.

In FIG. 3, a perspective view of the strap member 10 is shown with the rifle 16 attached thereto and illustrating another example of its versatility. In this drawing, the first strap member 24 is illustrated wrapped around a tree trunk 60 with the second strap member 32 received around a tree branch 62. The strap assembly 10, in this example, is used to hold the rifle 16 in place for distance sighting using a target 64.

Figure 4:
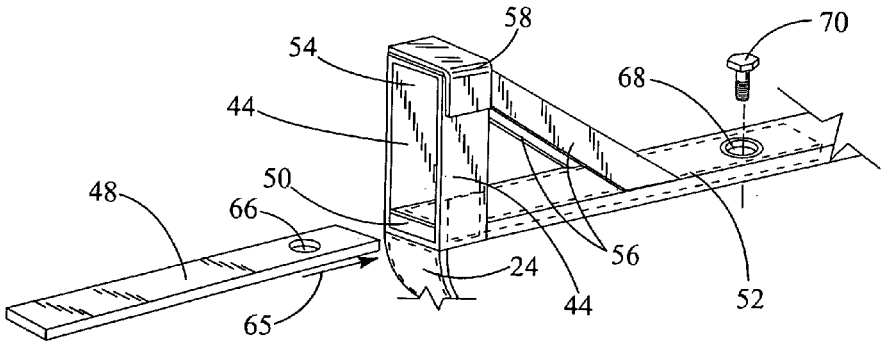
FIG. 4 is a perspective view of the rifle butt cradle made of strap material and having a horizontal sleeve in the bottom thereof for receiving a horizontal metal reinforcing member to prevent slippage when the strap assembly is secured to a horizontal surface.

In FIG. 4, a perspective view of the rifle butt cradle 44 is illustrated. In this drawing, the horizontal sleeve 50 in the bottom portion 52 of the cradle is shown positioned for receiving the horizontal reinforcing member 48, as indicated by arrow 65. The member 48 can be made of metal, hard plastic and other rigid materials and used to prevent slippage when the strap assembly 10 is secured to a horizontal surface. The reinforcing member 48 can include a grommet hole 66, which is indexed with a grommet 68 in the bottom portion 52. The grommet hole 66 and grommet 68 can be used for receiving a fastener 70 for securing the strap assembly 10 on top of the bench 12 or other rifle support object. The fastener 70 can be a threaded bolt, threaded screw, nail, upright pin and like fasteners.

Figure 5:
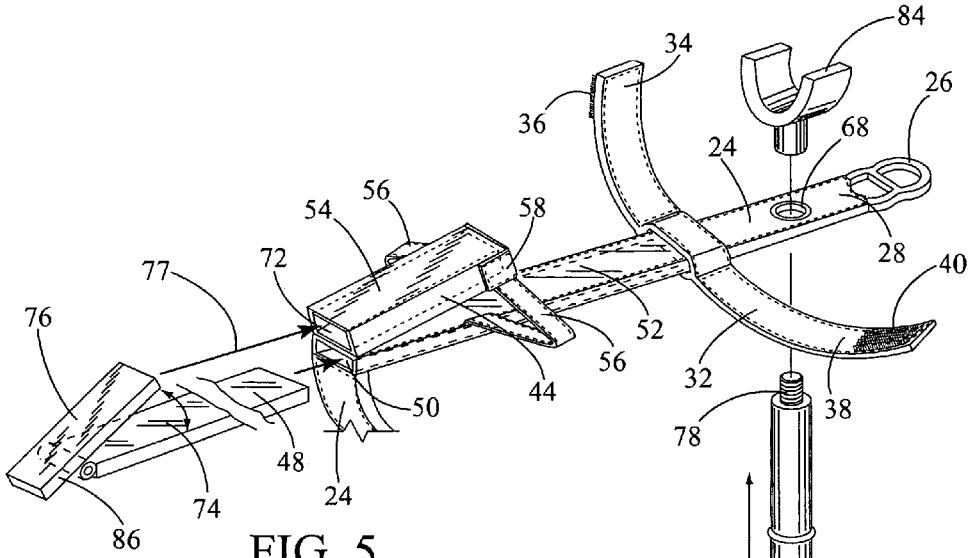
FIG. 5 is another perspective view of the rifle butt cradle having a vertical sleeve and the horizontal sleeve for receiving an "L" shaped, hinged reinforcing member for holding the rifle butt cradle securely next to an edge of a target shooting bench.

In FIG. 5, a perspective view of another embodiment of the rifle butt cradle 44 is shown having the vertical portion 54 with a vertical sleeve 72 folded on the horizontal portion 52 with sleeve 50. In this drawing, an "L" shaped, hinged reinforcing member 74 is shown. The "L" shaped, hinged reinforcing member 74 includes the horizontal reinforcing member 48 for receipt in the sleeve 50 and a hinged vertical reinforcing member 76 for receipt in the vertical sleeve 72, as indicated by arrow 77.

In this drawing, the first strap member 24 includes the grommet 68 positioned for being below the front portion 42 of the rifle 16 as shown in FIG. 1. The grommet 68 is used to receive a threaded portion 78 in the top of a telescoping, monopod rifle support 80. The monopod rifle support 80 can include a pointed end 82 for engaging the top of a ground surface. Also, the support 80 can be a bipod, tripod and other types of support objects and with or without a pointed end. The threaded portion 78 is screwed into a bottom of a "V" shaped yoke 84. The yoke 84 is used to support the front portion 42 of the rifle 16 similar to the sandbag 20 and the tree branch 62 shown in FIGS. 1 and 3.

Figure 6:
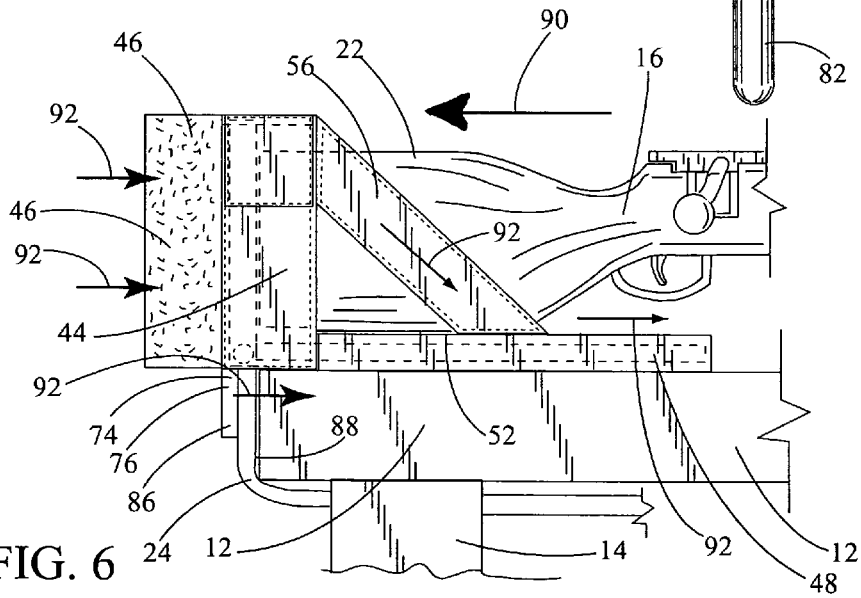
FIG. 6 is a side view of the rifle butt cradle mounted on top of the target shooting bench and illustrating how the "L" shaped, hinged reinforcing member in the cradle is used to secure the rifle in place during rifle recoil.

In FIG. 6, a side view of the rifle butt cradle 44 is shown mounted on top of the target shooting bench 12 and illustrating how the "L" shaped, hinged reinforcing member 74 is used to secure the rifle 16 in place during shooting recoil. In this drawing, a lower lip 86 of the vertical reinforcing member 76 is shown extending below the top of the bench 12 and secured against a portion of the first strap member 24 and a vertical edge 88 of the bench. The recoil force of the rifle 16 is shown as large arrow 90. The recoil force 90 is absorbed by an equal and opposite force, shown as small arrows 92. This is accomplished by securing the rifle 16 tightly on the strap assembly 10 and tightly on top of the bench 12. Also, the securing of the rifle 16 is aided by the "L" shaped hinged reinforcing member 74 and the cradle 44, supported with the angled support straps 56, holding the rifle butt 22 in place on top of the bench 12 and preventing the cradle 44 from slipping off the edge of the bench.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which as exclusive privilege and property right is claimed are defined as follows:

1. A rifle recoil absorbing strap assembly for absorbing rifle recoil from a rifle, a pistol and other firearms, the strap assembly is flexible and can be easily and quickly attached to a permanent rifle support object or moveable, non-permanent rifle support object when long range target shooting, hunting, distance sighting and other firing activities, the strap assembly comprising:

an elongated, flexible, horizontal first strap member with adjustable and releasable fastener, the adjustable and releasable fastener used for securing together a first end and a second end of the first strap member, the first strap member adapted for receipt around a portion of the rifle support object;

a flexible, vertical second strap member attached to a portion of the first strap member, the second strap member having a first end and an opposite second end, the first and second end of the second strap member adapted for receipt around a front portion of the rifle and secured thereto for preventing upward movement of the rifle when firing;

a rifle butt cradle attached to a portion of the first strap member, the cradle adapted for receiving and securing a rifle butt of the rifle therein, whereby when the strap assembly is secured to a rifle securing object and the rifle is held thereon, the strap assembly greatly reduces rifle recoil during the firing of the rifle;

a horizontal reinforcing member in a bottom portion of the cradle, the reinforcing member used to prevent the strap assembly from sliding on top of the rifle support object; and a horizontal sleeve disposed in a portion of the first strap member, the horizontal sleeve for receiving the horizontal reinforcing member therein.

2. The strap assembly as described in claim 1 wherein the cradle includes a horizontal bottom portion, a "U" shaped vertical portion and angled support straps.

3. The strap assembly as described in claim 2 further including an "L" shaped, hinged reinforcing member attached to the horizontal bottom portion and the "U" shaped vertical portion in the cradle for helping secure the rifle butt therein.

4. A rifle recoil absorbing strap assembly for absorbing rifle recoil from a rifle, the strap assembly is flexible and can be easily and quickly attached to a permanent rifle support object or moveable, non-permanent rifle support object when target shooting, hunting, distance sighting and other firing activities, the strap assembly comprising:

an elongated, flexible, horizontal first strap member with adjustable and releasable fastener, the adjustable and releasable fastener used for securing together a first end and a second end of the first strap member, the first strap member adapted for receipt around a portion of the rifle support object;

a flexible, vertical second strap member attached to a portion of the first strap member, the second strap member having a first end with loop fasteners and an opposite second end with hook fasteners, the first and second end of the second strap member adapted for receipt around a front portion of the rifle and secured thereto using the hook and loop fasteners for preventing upward movement of the rifle when firing; and a rifle butt cradle having a horizontal bottom portion with a reinforcement member therein and a "U" shaped vertical portion, the cradle attached to a portion of the first strap member, a portion of the first strap member includes a horizontal sleeve therein for receiving the reinforcing member therein, the "U" shaped vertical portion adapted for receiving and securing a rifle butt of the rifle therein, whereby when the strap assembly is secured to a rifle securing object and the rifle is held thereon, the strap assembly greatly reduces rifle recoil during the firing of the rifle.

5. The strap assembly as described in claim 4 wherein the reinforcing member is an "L" shaped hinged reinforcing member attached to the horizontal bottom portion and the "U" shaped vertical portion in the cradle for helping secure the rifle butt therein.

6. The strap assembly as described in claim 4 wherein the cradle includes angled support straps, one end of the angled support straps attached to the top of the "U" shaped vertical portion and the opposite ends of the angled support straps attached to the horizontal bottom portion.

7. The strap assembly as described in claim 6 further including a flap mounted on one side of the top of the "U" shaped vertical portion of the cradle, the flap folded over the top of the vertical portion and secured to an opposite side of the top of the "U" shaped vertical portion for securing the rifle butt inside the cradle.

8. The strap assembly as described in claim 4 wherein the horizontal reinforcing member includes a grommet hole therein and indexed with a grommet in the horizontal bottom portion, the grommet hole and grommet used for receiving a fastener for securing the strap assembly to the rifle support object.

9. The strap assembly as described in claim 4 further including a grommet in a portion of the first strap member, the grommet adapted for attaching the strap assembly to the rifle support object.

10. The strap assembly as described in claim 4 wherein the second strap member is slidably mounted on the first strap member for adjusting the second strap member along a length of the first strap member.

11. A rifle recoil absorbing strap assembly for absorbing rifle recoil from a rifle, a pistol and other firearms, the strap assembly is flexible and can be easily and quickly attached to a permanent rifle support object or moveable, non-permanent rifle support object when long range target shooting, hunting, distance sighting and other firing activities, the strap assembly comprising:

an elongated, flexible, horizontal first strap member with adjustable and releasable fastener, the adjustable and releasable fastener used for securing together a first end and a second end of the first strap member, the first strap member adapted for receipt around a portion of the rifle support object;

a flexible, vertical second strap member slidably attached along a length of the first strap member, the second strap member having a first end with loop fasteners and an opposite second end with hook fasteners, the first and second end of the second strap member adapted for receipt around a front portion of the rifle and secured thereto using the hook and loop fasteners for preventing upward movement of the rifle when firing; and a rifle butt cradle having a horizontal bottom portion with horizontal sleeve for receiving a rigid reinforcement member therein and a "U" shaped vertical portion, the cradle attached to a portion of the first strap member, the "U" shaped vertical portion adapted for receiving and securing a rifle butt of the rifle therein, whereby when the strap assembly is secured to a rifle securing object and the rifle is held thereon, the strap assembly greatly reduces rifle recoil during the firing of the rifle.

12. The strap assembly as described in claim 11 wherein the reinforcing member is an "L" shaped hinged reinforcing member having a horizontal portion and a vertical portion, the vertical portion received in a vertical sleeve in the "U" shaped vertical portion in the cradle for helping secure the rifle butt therein.

13. The strap assembly as described in claim 11 wherein the cradle includes angled support straps, one end of the angled support straps attached to the top of the "U" shaped vertical portion and the opposite ends of the angled support straps attached to the horizontal bottom portion.

14. The strap assembly as described in claim 11 further including a flap mounted on one side of a top of the "U" shaped vertical portion of the cradle, the flap folded over the top of the vertical portion and secured to an opposite side of the top of the "U" shaped vertical portion for securing the rifle butt inside the cradle.

15. The strap assembly as described in claim 11 wherein the horizontal reinforcing member includes a grommet hole therein and indexed with a grommet in the horizontal bottom portion of the cradle, the grommet hole and grommet used for receiving a fastener for securing the strap assembly to the rifle support object.

16. The strap assembly as described in claim 11 further including a grommet in a portion of the first strap member, the grommet adapted for attaching the strap assembly to a vertical rifle support object, a permanent rifle support object or a moveable, non-permanent rifle support object.

17. The strap assembly as described in claim 11 further including a grommet in a portion of the first strap member and next to a front portion of the rifle, the grommet adapted for attaching the strap assembly to a vertical rifle support monopod, a bipod or tripod.

* * * * *